United States Patent [19]

Travis

[11] 4,361,226

[45] Nov. 30, 1982

[54] DISPLAY PACKAGE AND THE LIKE

[75] Inventor: Jack R. Travis, Lancaster, Ohio

[73] Assignee: Anchor Hocking Corporation, Lancaster, Ohio

[21] Appl. No.: 323,829

[22] Filed: Nov. 23, 1981

Related U.S. Application Data

[63] Continuation of Ser. No. 180,342, Aug. 22, 1980, abandoned.

[51] Int. Cl.[3] ..... B65D 25/54; B65D 5/50; B65D 85/62

[52] U.S. Cl. ..... 206/45.31; 206/45.19; 206/45.34; 206/564; 206/592; 229/36

[58] Field of Search ..... 200/45.31, 45.19, 45.14, 200/45.34, 564, 591, 592, 486, 45.11

[56] References Cited

U.S. PATENT DOCUMENTS

| | | | |
|---|---|---|---|
| D. 261,775 | 7/1982 | Smith et al. | 206/45.31 |
| 2,031,381 | 2/1936 | McCallum | 206/44.11 |
| 2,151,503 | 3/1939 | Dowst | 206/45.19 |
| 2,210,385 | 8/1940 | Salfisberg | 206/45.31 |
| 2,219,183 | 10/1940 | Hartmett et al. | 206/44.11 |
| 2,571,833 | 10/1951 | Chidsey, Jr. | 206/45.31 |
| 2,593,430 | 4/1952 | Frankenstein | 206/45.19 |
| 2,921,673 | 1/1960 | Ryan | 206/45.31 |
| 4,146,128 | 3/1979 | Hogg et al. | 206/45.19 |

*Primary Examiner*—William T. Dixson, Jr.

*Attorney, Agent, or Firm*—Holland, Armstrong, Wilkie & Previto

[57] ABSTRACT

A display package in which a number of articles are packaged in a container and wherein a single article may be viewed through the cover of the container.

2 Claims, 7 Drawing Figures

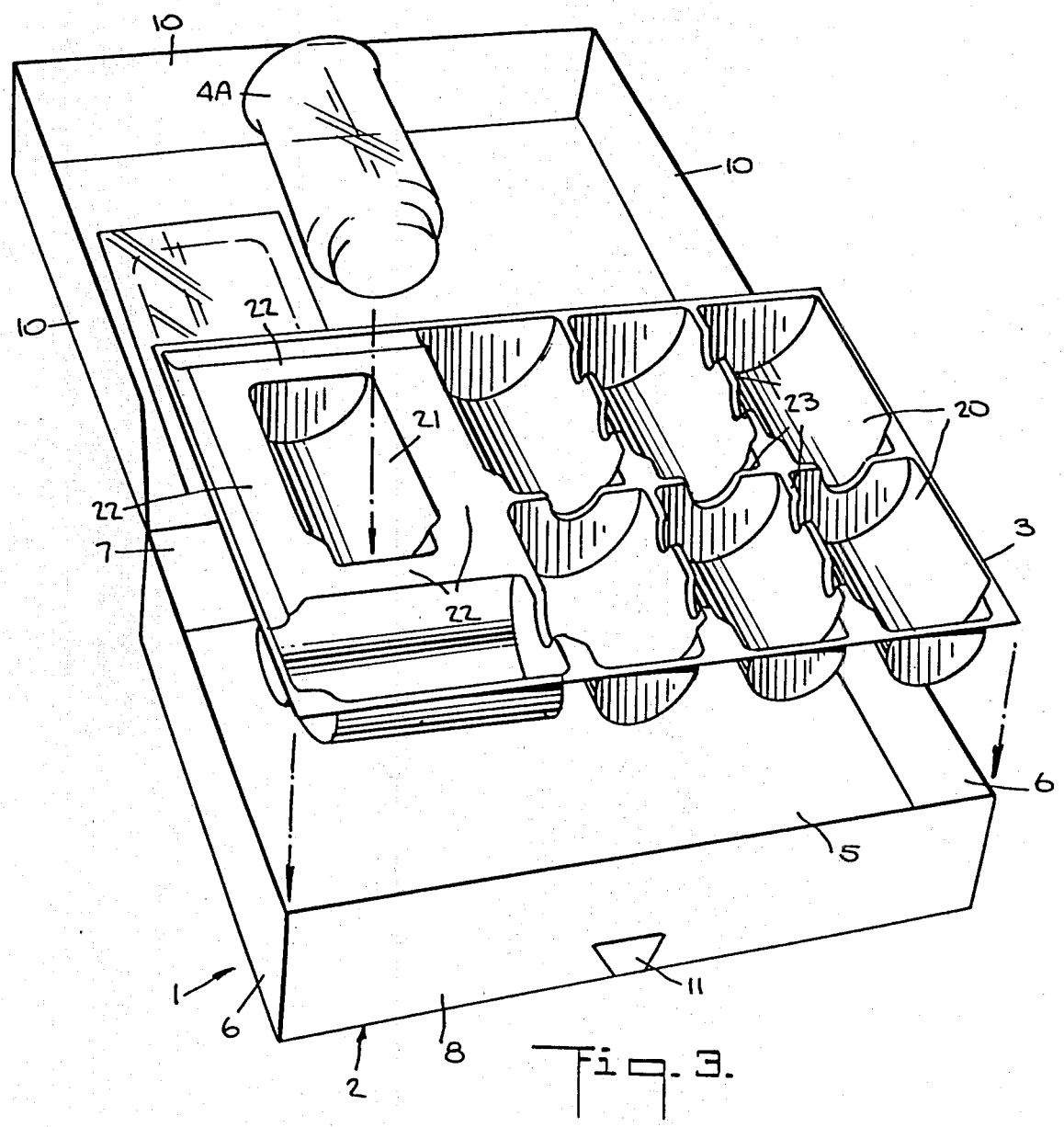
Fig. 3.
Fig. 7.
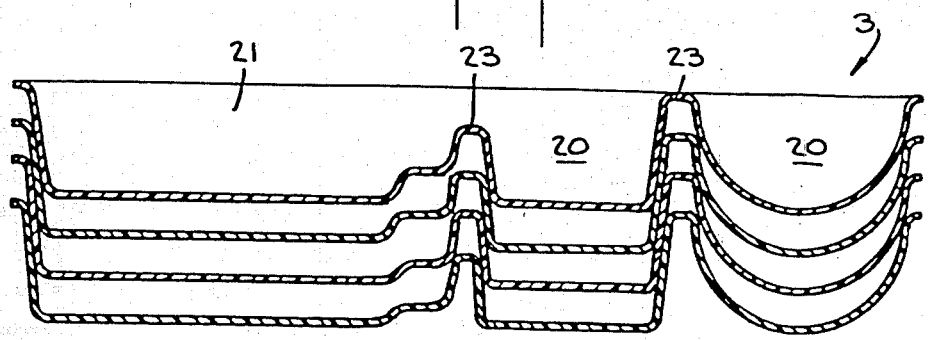

DISPLAY PACKAGE AND THE LIKE

This application is a continuation of pending United States Application Ser. No. 180,342 filed Aug. 22, 1980, now abandoned.

DESCRIPTION

The present invention is directed to a display package and the like and more particularly to a display package which has a number of articles therein and which is adapted to permit one of the articles to be displayed through the cover.

In packaging articles, such as glass tumblers, and the like, the articles are sometimes placed in closed cartons with pictures of the article on the cover or the articles are placed in a carton with a transparent cover so that all the articles are visible.

Articles are also sometimes packaged in carrying packs in which the articles are either left bare or covered with a transparent plastic covering.

The present invention has for one of its objects the provision of an improved display package in which a plurality of articles are packaged in a carton with a single packaged article displayed from the outside.

Another object of the present invention is the provision of an improved display package which may be easily manufactured and assembled.

Another object of the present invention is the provision of an improved display package which may be stacked for storage and shipment and which can be assembled or "set up" when it is ready to be used.

Other and further objects of the invention will be obvious upon an understanding of the illustrative embodiment about to be described, or will be indicated in the appended claims; and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 3 is an exploded view of the package of the present invention.

FIG. 7 is a sectional view showing a plurality of article-holding inserts in stacked relationship to each other.

Figure 1:
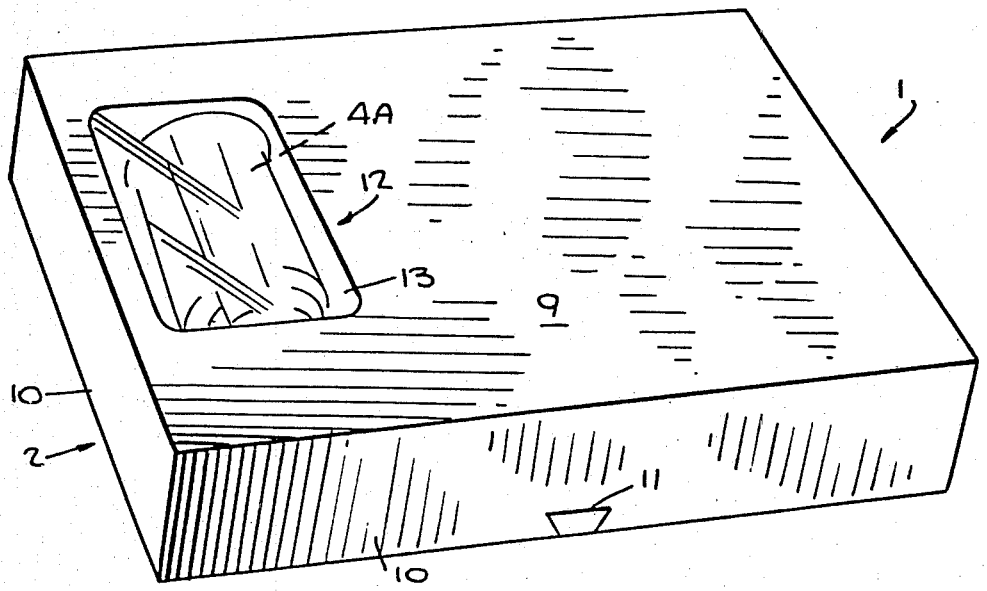
FIG. 1 is a perspective view of a package made in accordance with the present invention.
Figure 2:
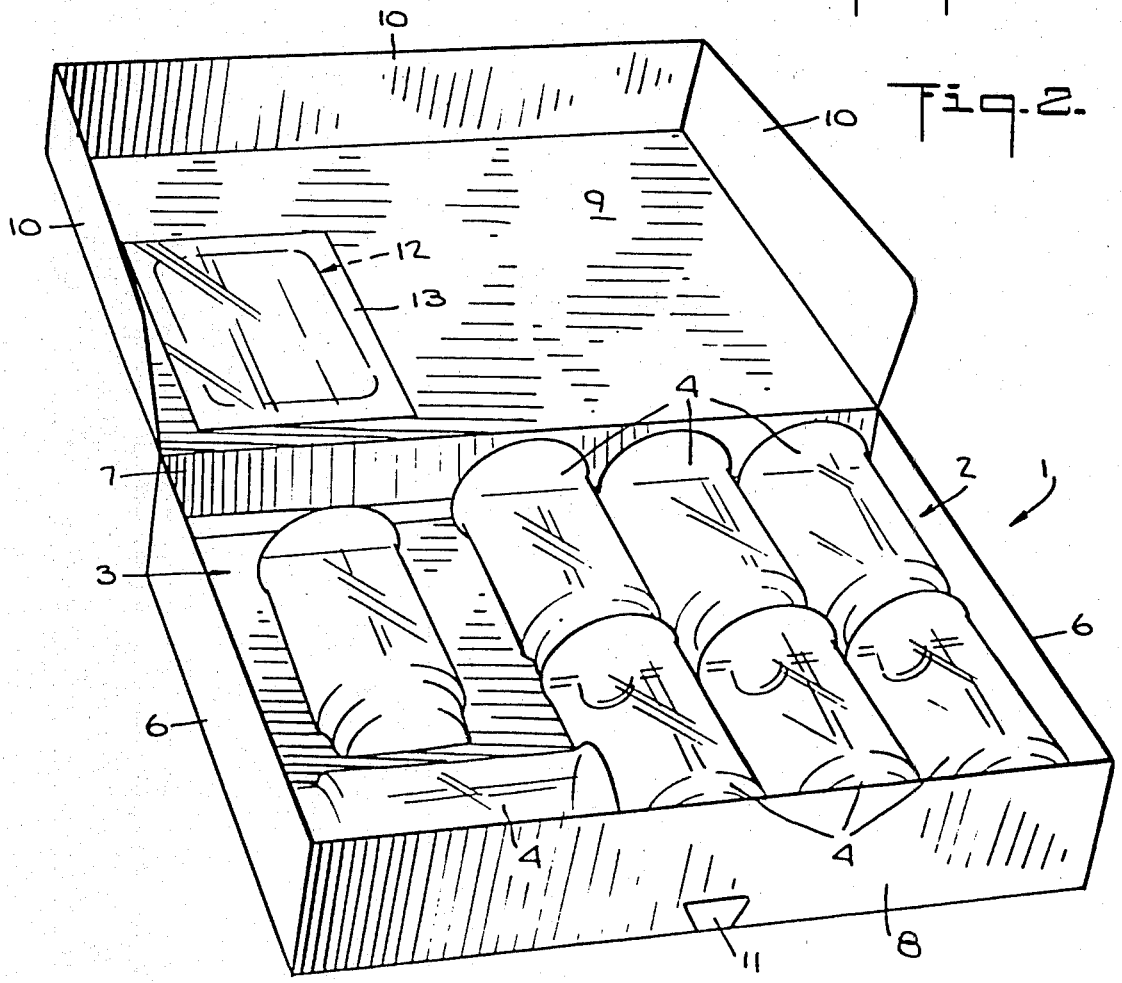
FIG. 2 is a perspective view of the package of the present invention with the cover open.
Figure 4:
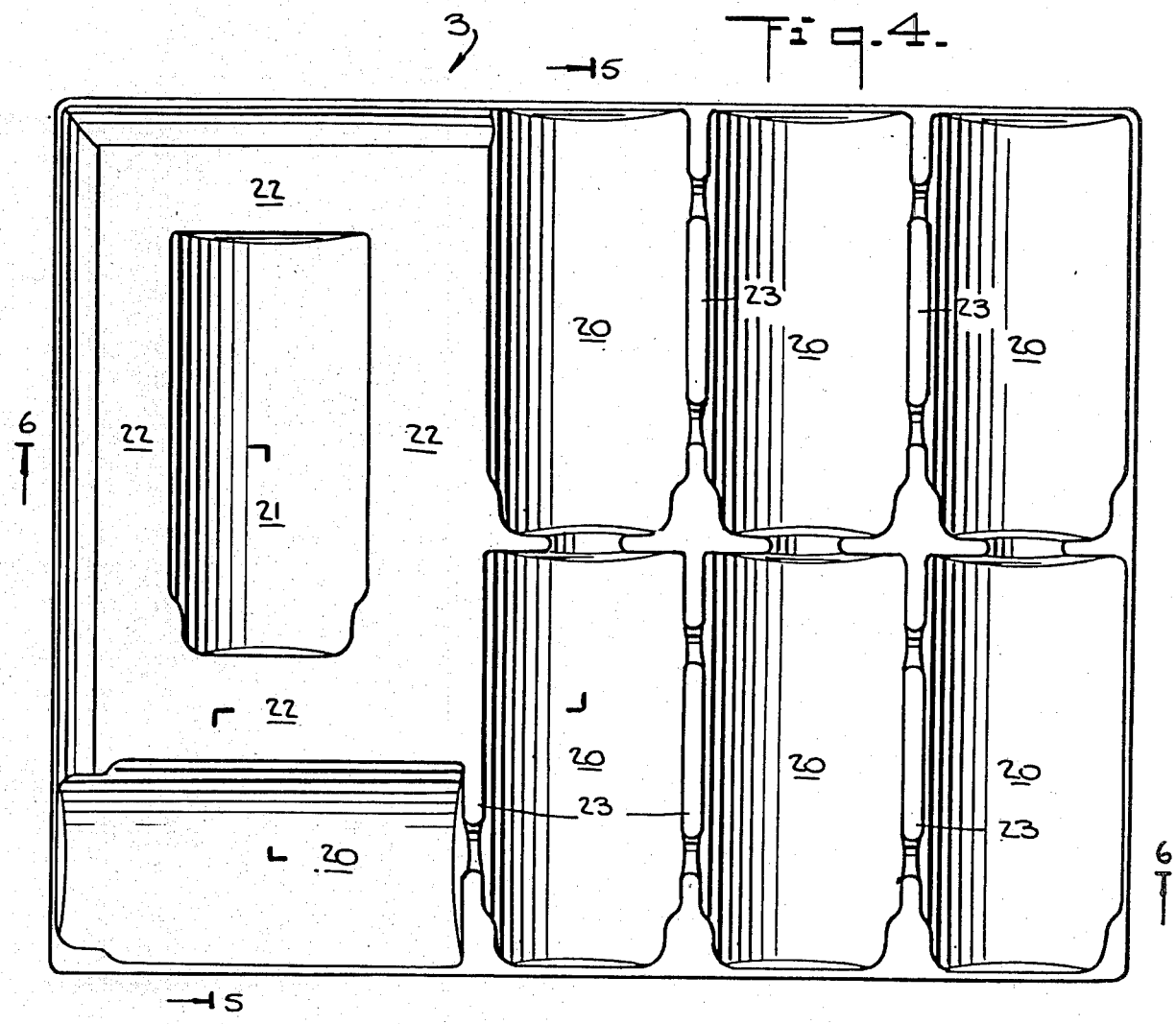
FIG. 4 is a plan view of the article-holding insert of the package of the present invention.
Figure 6:
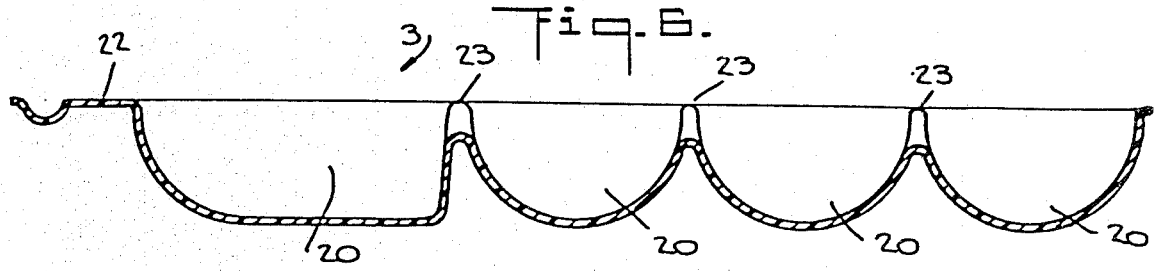
FIG. 6 is a sectional view taken along line 6—6 of FIG. 4.
Figure 5:
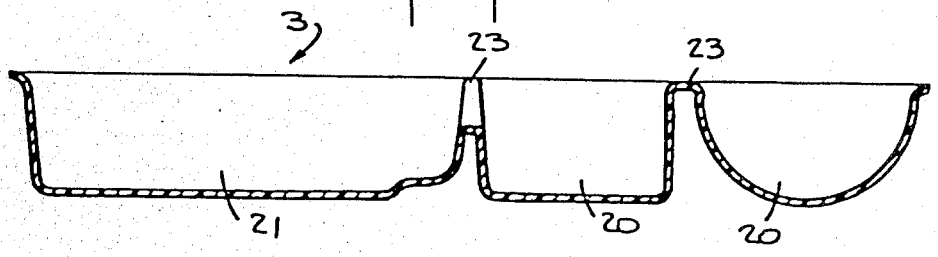
FIG. 5 is a sectional view taken along line 5—5 of FIG. 4.

The package 1 of the present invention comprises an outer container 2, an inner article holding insert 3 and a plurality of articles 4 to be packaged.

The outer container 2 comprises the usual bottom wall 5, side walls 6, rear wall 7 and front walls 8. A cover 9 is pivotly attached to the rear wall 7 and may be provided with a downwardly extending side and front flaps 10 which lie adjacent to the side walls 6 and front wall 8 when the cover 9 is closed. Latching means 11 may be provided on the front cover flap 11 and the front wall 8 to hold the cover 9 in its closed position.

The outer container 2 is preferably of the type which is adapted to lie flat when not in use by bending it along various fold lines (not shown) as is well known in the art. The cover 9 has a window 12 therein which is protected by a transparent sheet 13 which may be made of plastic material and through which a single article 4A of the articles 4 may be viewed.

The articles 4 and 4A of the present invention are shown as being glass tumblers. However, it will be understood that, if desired, the invention may be used in connection with other articles. In addition, although the articles 4 and 4A are shown as being of the same size and shape, it is also within the purview of the present invention for the articles to be of differenct sizes and shapes.

The article-holding insert 3 is adapted to be removably mounted within the outer container 2 and is provided with a plurality of separate article-receiving pockets 20 and 21 for removably accommodating therewithin the articles 4 and 4A, respectively, to be packaged. Preferably, the article-holding insert 3 is made from a light one-piece molded plastic material. As shown in FIG. 7, when the article-holding inserts 3 are to be stored or shipped and before they are to be used, they may be stacked. Each article-holding insert 3 is provided with a plurality of integral pockets 20 and 21 which are spaced from each other by integral separators 22 and 23.

One of the article-holding pockets 21 of the insert 3 is in superimposed relationship with the window 12 in the cover 9 when the cover 9 is in its closed position, as shown in FIG. 1. Thus, when the cover 9 is closed, a single article 4A in pocket 21 is seen through the window 12 while the other articles 4 in pockets 20 will not be seen. Hence, the article-holding insert 3 may have the article-holding pockets 20 in a variety of locations and orientations, i.e. upright or horizontal, as may be desired for economy or convenience since the orientation will not be seen by the buyer. In addition, the orientation of the pockets 20 may be made to fit the outer container without regard to the aesthetics of their arrangement since the only article 4A visible to the buyer is the one that is displayed through the window 12.

Furthermore, the pocket 21 holding the article 4A is spaced from the other pockets 20 and from the side wall of the box by a substantially wide flange portion 22. This will permit the article 4A to be seen through the window 12 in its substantially isolated position without the viewer seeing the other articles 4 in the container. Preferably, the article 4A seen through the cover is located near one corner of the container. However, its location may be changed if desired.

When the articles are to be packaged, the outer container 2 is "set up" and an article-holding insert 3 is placed within the outer container 2. The articles 4 and 4A are then assembled within the pockets 20 and 21 of the article-holding insert 3 and the cover 9 is closed and held in place by the latch means 11. The single article 4A will be visible through the window 12, without the other articles 4 being visible from the outside.

It will thus be seen that the present invention provides an improved display package for a plurality of articles in which a single article is visible, which may be easily manufactured and assembled and which may be stacked for storage and shipment until it is ready to be used.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A display package comprising an outer container and a cover hingedly mounted thereto and adapted to pivot from an open position to a closed position overlying the outer container, a one piece insert having article-holding pockets therein removably mounted within the outer container for holding articles therein, said article-holding pockets being formed by integral pocket-forming dividers, said outer container having side, end and bottom walls, said side, end and bottom walls being devoid of windows, said cover having a single window therein, said window being so positioned and so dimensioned so that a predetermined single article only in a predetermined single pocket may be seen through the outer container when the cover is in said closed position, the predetermined pocket for the predetermined single article seen through said window is spaced from the other article-holding pockets by pocket-forming dividers which are wider than the other pocket-forming dividers, said window being near a corner of said cover and said predetermined article and predetermined pocket being near a corner of said insert underlying the corner of said cover when the cover is in its closed position, said window and said predetermined pocket adapted to align with each other when the cover is in its closed position to permit the predetermined single article to be seen through the said window.

2. A display package as claimed in claim 1 wherein said window and said article is in one corner of said container.

* * * * *